United States Patent [19]

Mailliet et al.

[11] Patent Number: 4,557,468

[45] Date of Patent: Dec. 10, 1985

[54] APPARATUS FOR PLUGGING THE TAPHOLE OF A SHAFT FURNACE

[75] Inventors: Pierre Mailliet; Léon Ulveling, both of Howald; Jean Metz, Luxembourg, all of Luxembourg

[73] Assignee: Paul Wurth S.A., Luxembourg

[21] Appl. No.: 592,790

[22] Filed: Mar. 23, 1984

[30] Foreign Application Priority Data

Mar. 23, 1983 [LU] Luxembourg ..... 84711

[51] Int. Cl.[4] ..... C21B 7/12

[52] U.S. Cl. ..... 266/273

[58] Field of Search ..... 266/273, 271, 45, 272

[56] References Cited

U.S. PATENT DOCUMENTS

| | | | |
|---|---|---|---|
| 3,667,748 | 6/1972 | Dienenthal et al. | 266/273 |
| 3,765,663 | 10/1973 | Legille et al. | 266/273 |
| 4,201,373 | 5/1980 | Ulveling et al. | 266/273 |
| 4,220,321 | 9/1980 | Brücher | 266/273 |
| 4,227,682 | 10/1980 | Ulveling et al. | 266/273 |
| 4,247,088 | 1/1981 | Ueno et al. | 266/273 |

*Primary Examiner*—L. Dewayne Rutledge
*Assistant Examiner*—S. Kastler
*Attorney, Agent, or Firm*—Fishman & Dionne

[57] ABSTRACT

An apparatus for plugging the taphole of a shaft furnace is presented which comprises a fixed support frame having a main pivoting joint and a jib device. The jib consists of a rotary support joint. The other end of the rotary support arm having one end which is pivotably mounted on the main pivot joint. The other end of the rotary support arm is pivotably mounted via an auxiliary pivot to a clay gun. A hydraulic jack having a piston and cylinder arrangement is mounted on journals in the fixed support frame. The piston rod portion of the hydraulic jack actuates the support arm wherein the arm and the clay gun attached thereto pivot from a retracted position into an operative position or vice versa. An important feature of the present invention is that the support arm has a bend therein such that the inside of the bend is disposed about the journals of the jack when the clay gun occupies its retracted position. Thus, the journals in the fixed support frame which secure the hydraulic jack are juxtaposed to the main pivoting joint. Still another important feature of the present invention is that the hydraulic jack is positioned so as to continually move through a groove or recess provided for it in the rotary support arm.

5 Claims, 10 Drawing Figures

APPARATUS FOR PLUGGING THE TAPHOLE OF A SHAFT FURNACE

BACKGROUND OF THE INVENTION

This invention relates to an apparatus for plugging the taphole of a shaft furnace. More particularly, this invention relates to an apparatus comprised of a fixed support frame having a main pivot and a jib. The jib consists of a rotary support arm which is rotatably mounted via a first end to the main pivot joint. The second end of the rotary support arm is pivotably mounted via an auxiliary pivot to a clay gun. A guide bar is pivotably connected at one end to the clay gun and at the other end to the fixed frame. The apparatus disclosed herein also has a hydraulic jack which is mounted on journals in the fixed support frame. The jack has a piston rod which accurates the support arm, thereby causing the support arm and the clay gun to alternately pivot from a retracted position to an operative position.

Taphole plugging devices of this type are described in French Pat. No. A 71 42 470 and are well known to those skilled in the art. Conventional devices of the type herein described have been in worldwide use for over ten years. During this time period, conventional plugging devices have undergone many changes and improvements, particularly for the purpose of improving and providing a satisfactory trajectory for the clay gun and for reducing the space which the clay gun occupies in the vertical direction. The most important improvements in conventional plugging devices have been made in connection with the angles of inclination of the main pivot and the auxiliary pivot, both in respect to each other and in respect to the vertical axis.

While the height of the plugging apparatii have been improved in recent years, problems still exist in regard to the overall area occupied by these devices. It is well known that the hydraulic jack used in connection with known plugging devices act on a support arm which is positioned in close proximity to a main pivot joint. The journals of the hydraulic jack therefore, must be positioned at a a relatively large distance away from the main pivot joint thereby necessitating a comparatively large frame. Moreover, the cylinder of the jack used in known plugging devices usually extends a considerable length beyond this large frame. As a result, the cylinder forms an obstruction over both the entire length of the plugging device as well as the surface swept out by the cylinder (since the cylinder pivots about the journals of the jack during the operation of the clay gun).

Another problem associated with known taphole plugging devices is that when the clay gun is in its retracted position, access to the clay gun by an operator is impeded from the side opposite that of the furnace. This lack of access to the clay gun in its retracted position is troublesome and undesirable from the standpoint of operational efficiency.

SUMMARY OF THE INVENTION

The above discussed and other problems of the prior art are overcome or alleviated by the taphole plugging apparatus of the present invention. In accordance with the present invention, an apparatus for plugging the taphole of a shaft furnace is provided which comprises a fixed support frame having a main pivoting joint and a jib device. The jib consists of a rotary support arm having one end which is pivotably mounted on the main pivot joint. The other end of the rotary support arm is pivotably mounted via an auxiliary pivot to a clay gun. A guide bar is also pivotably connected at one end to the clay gun and at the other end to the fixed support frame. A hydraulic jack having a piston and cylinder arrangement is mounted on journals in the fixed support frame. The piston rod portion of the hydraulic jack accuates the support arm wherein the arm and the clay gun attached thereto pivot from a retracted position into an operative position or vice versa.

An important feature of the present invention is that the hydraulic jack is positioned so as to continually move through a groove or recess provided for it in the rotary support arm. Also, the free end of the rod is pivotably connected to a pivot joint provided on the lower side of the support arm. Still another important feature of the present invention is that the support arm has a bend therein such that the inside of the bend is disposed about the journals of the jack when the clay gun occupies its retracted position.

The taphole plugging device of the present invention provides a smaller distance between the journals which secure the hydraulic jack and the main pivot joint. This smaller distance enables the rear portion of the fixed support frame to be considerably reduced in size thereby reducing the overall size of the apparatus. Moreover, unlike known prior art devices, the free end of the cylinder portion of the hydraulic jack no longer extends beyond the rear end of the frame. Thus, the journals in the fixed support frame which secure the hydraulic jack are juxtaposed to the main pivoting joint. It will be appreciated that the reduction in distance between these journals and the main pivoting joint is not due to a mere structural modification, but in fact, by the novel bent portion in the support arm together with the recess in the arm which provides a passage to the rod of the hydraulic jack.

Another advantage of the novel bend in the support arm is evident when the clay gun is in its retracted position. In the present invention, the clay gun will be positioned at a relatively large distance from tap spouts and will then be substantially parallel to the axis of the tap spout. Thus, access will no longer be impeded from the side opposite that of the furnace when the clay gun is in its retracted position.

As mentioned, an important feature of the present invention is the presence of a groove in the support arm. This groove permits the hydraulic jack and its associated piston rod to simultaneously pivot as the support arm pivots. Moreover, the piston rod will continually rest against the support arm throughout the pivoting movement. This arrangement will reduce the overall width of the jib and enable a guard plate to be mounted at the bottom of the jib, around the piston rod and the support arm.

Still another advantage and feature of the present invention is that the reduction in overall area or spaces occupied by the apparatus will be accompanied by an overall reduction in the mass of the frame. Accordingly, it will be appreciated that the present invention also reduces the cost of manufacturing and installing the taphole plugging device.

The above discussed and other advantages of the present invention will be apparent to and understood by those skilled in the art by the following detailed description and drawings.

BRIEF DESCRIPTION OF THE DRAWINGS

Referring now to the drawings wherein like elements are numbered alike in the several FIGURES.

DESCRIPTION OF A PREFERRED EMBODIMENT

Figure 1:
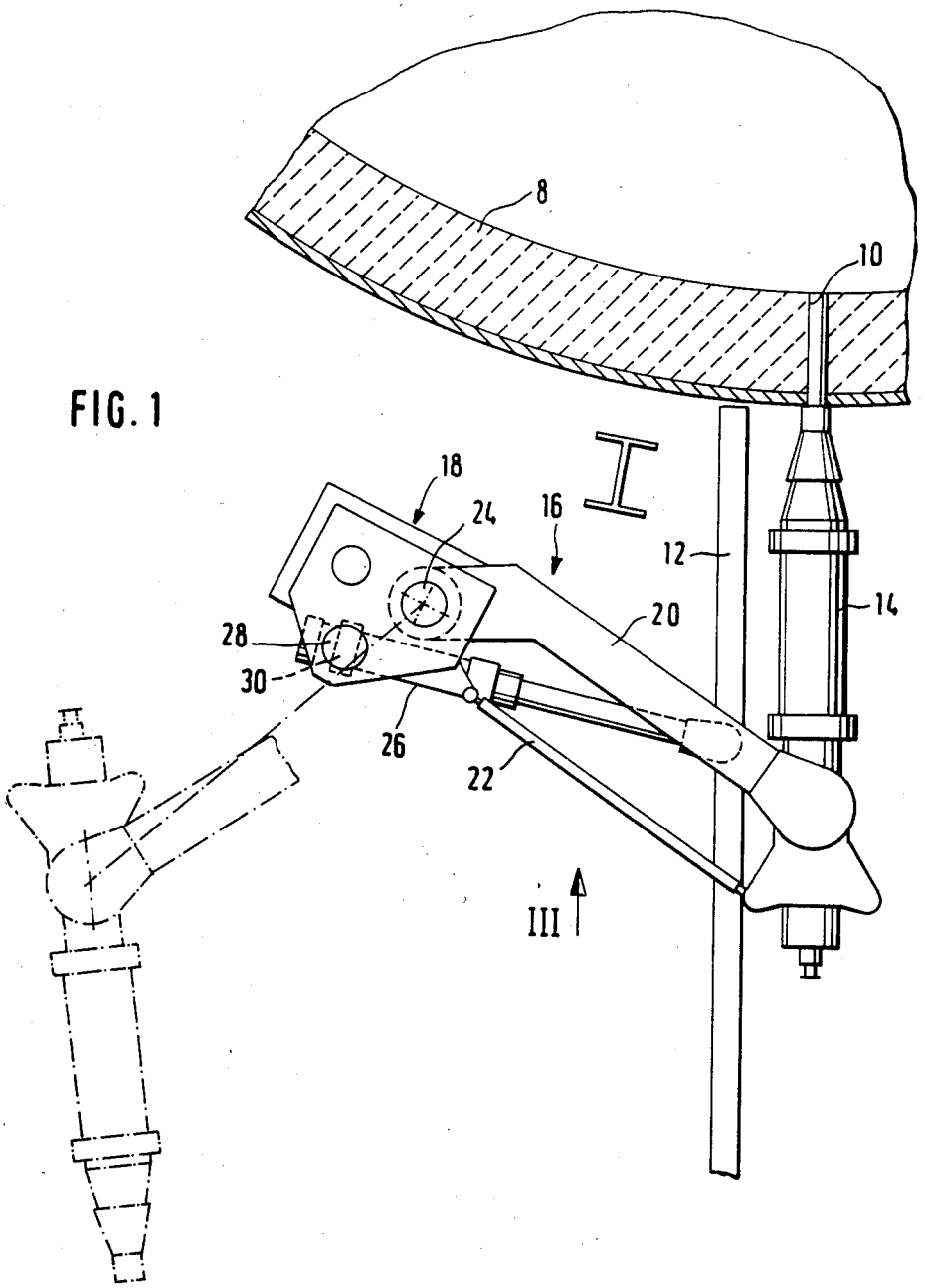
FIG. 1 is a side elevational view, partly in cross section, of a taphole plugging apparatus in accordance with the present invention.

Referring first to FIG. 1, a cross sectional view of a refractory wall 8 of a blast furnace (not shown) is shown. Refractory wall 8 is provided with a taphole 10 having a tap spout 12 in the prolongation of the taphole 10. In FIG. 1, a taphole plugging device in an operating position in accordance with the present invention is shown in the full lines while the dot-and-dash lines depict the apparatus in a retracted position. The taphole plugging apparatus of the present invention essentially consists of a clay gun 14 attached to one end of a jib 16, the jib being capable of pivoting on a fixed support frame 18. Jib 16 comprises a rotary support arm 20 and a guide bar 22. Guide bar 22 is preferably adjustable in length so as to permit the angle of inclination between gun 14 and support arm 20 to be selected as may be desired.

Support arm 20 is mounted on a main pivoting joint 24 of frame 18. Accordingly, support arm 20 can pivot under the action of a convention hydraulic jack 26 between the operative position shown in full lines and the retracted position shown in dot-and-dash lines.

It will be appreciated by those skilled in the art that the present invention is of the type of taphole plugging device known as a "120° stopper" indicating that the amplitude of rotation between the retracted position and the operative position is 120°.

Figure 2:
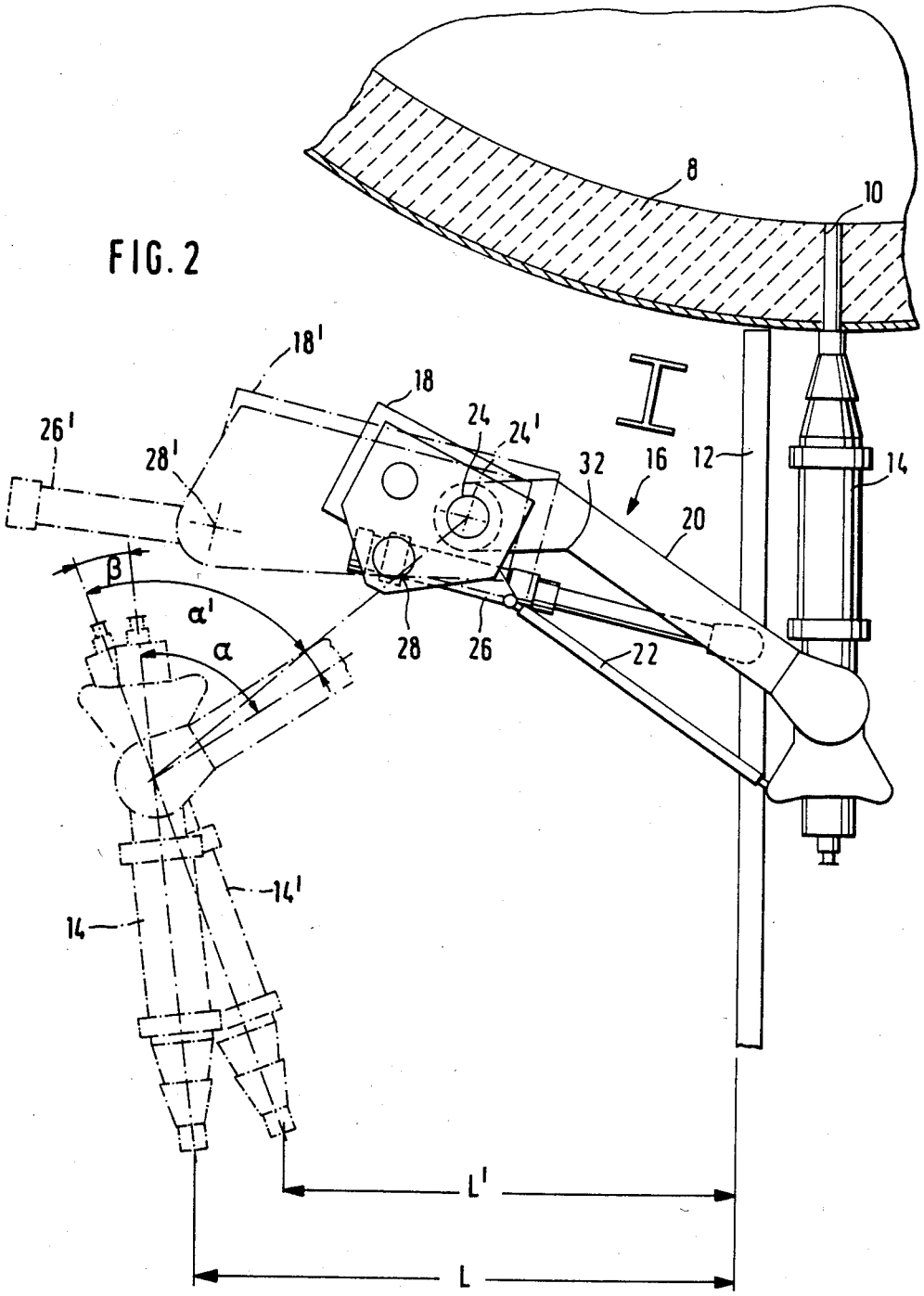
FIG. 2 is a side elevation view, partly in cross section, similar to FIG. 1 but showing a taphole plugging apparatus in accordance with prior art in dot-and-dash lines.
Figure 3:
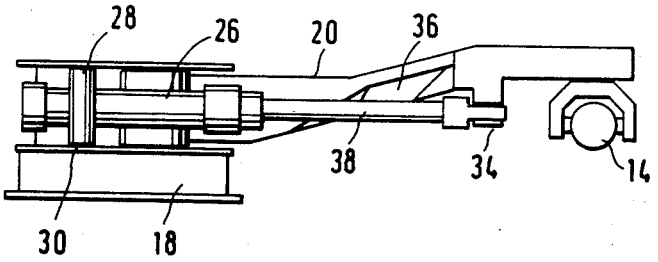
FIG. 3 is a side elevation view, partly in cross section, of the taphole plugging apparatus of FIG. 1 as viewed in the direction indicated by arrow 3 in FIG. 1.

Hydraulic jack 26 is pivotably mounted by means of journals 28 and 30 in fixed frame 18 (see FIG. 3). This permits the hydraulic jack 26 to easily pivot in the frame 18 when the jack is actuating arm 20. In accordance with one important feature of the present invention, journals 28 and 30 are mounted relatively close to the main pivoting joints 24. This distinct structural difference between the present invention and the prior art is clearly shown in FIG. 2 wherein a conventional well known taphole plugging device such as described herein above is shown in the dot-and-dash lines. It will be understood that the elements corresponding to the prior art which are similar to those elements in the present invention are marked with reference numerals having the addition of a prime (').

Referring again to FIG. 2, it is clear that journals 28' supporting jack 26' are mounted at a comparatively greater distance from the main pivoting joint 24. Accordingly, the prior art device necessitates a much larger frame 18' relative to frame 18 of the present invention. Moreover, the cylinder of the jack 26' extends, almost over its entire length, beyond the frame 18', such that in the course of its pivoting movement, the cylinder occupies the whole of the space behind the frame 18'.

Figure 4:
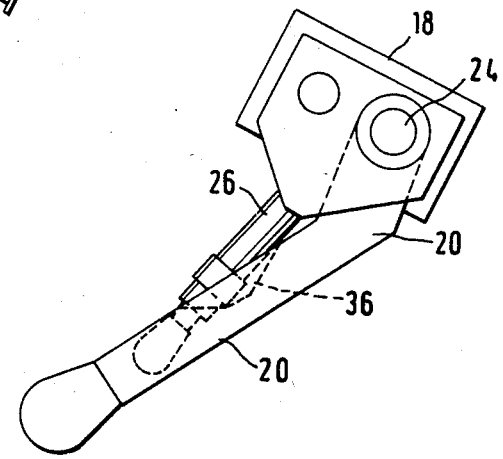
FIG. 4 is a plan view of the support arm of FIG. 1 in a retracted position and in accordance with the present invention.

The reduction in the distance between journals 28 and 30 of the main pivoting joint 24 reduces the overall size and mass of the frame 18. It will be understood that this reduction in the distance between journals 28 and 30 and joint 24 is provided by bend 32 in support arm 20. As shown in FIG. 4, it would be impossible to pivot arm 20 at an angle of 120° if not for the presence of bend 32 in arm 20. This is due to jack 20 and journals 28 and 30 which form an obstruction to the pivoting movement at a selected position. Conversely, the bent portion 32 of support arm 20, which moves back through the journals 28 and 30 of jack 26, enables the pivoting amplitude to be increased up to 120°.

Bend 32 in support arm 20 not only permits the jack to be attached to frame 18 at a position closer to the main pivoting joint 24, but also provides a more satisfactory angle for the positioning of the clay gun 14 in its retracted position. In FIG. 2, the angles and $\alpha$ and $\alpha'$ represent the angles between the axis of the support arm 20 and the axis of the clay gun 14 in the taphole plugging apparatus of the present invention and the prior art respectively. The angle $\beta$ in FIG. 2 represents the correction of the position of the clay gun 14 of the present invention relative to the axis of the tap spout 12. This correction factor $\beta$ also contributes to reducing the space occupied in front of the present invention, since the nose of the gun is urged forward a distance L from tap spout 12. This is in distinct contrast to the much shorter distance L' typically found in conventional prior art taphole plugging devices.

Figure 5:
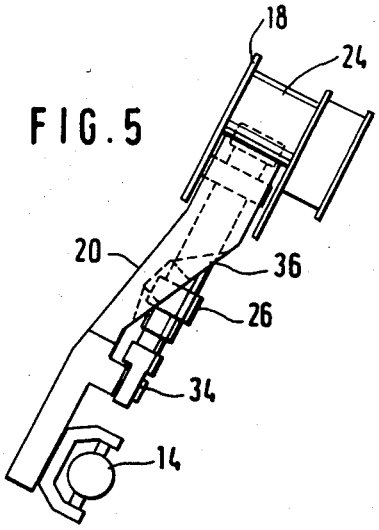
FIG. 5 is a side elevation view of the support arm of FIG. 4 in a retracted position.
Figure 6A:
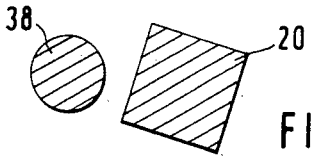
FIGS. 6A, 6B, 6C and 6D are cross sectional elevation views along the lines indicated by the arrows A, B, C and D respectively in FIG. 6.
Figure 6B:
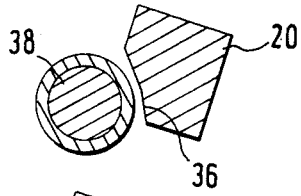
Figure 6C:
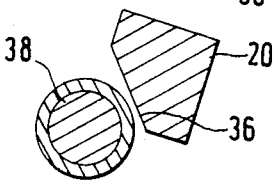
Figure 6D:
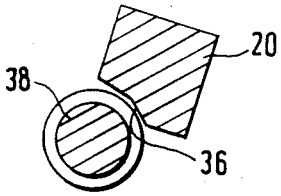
Figure 6:
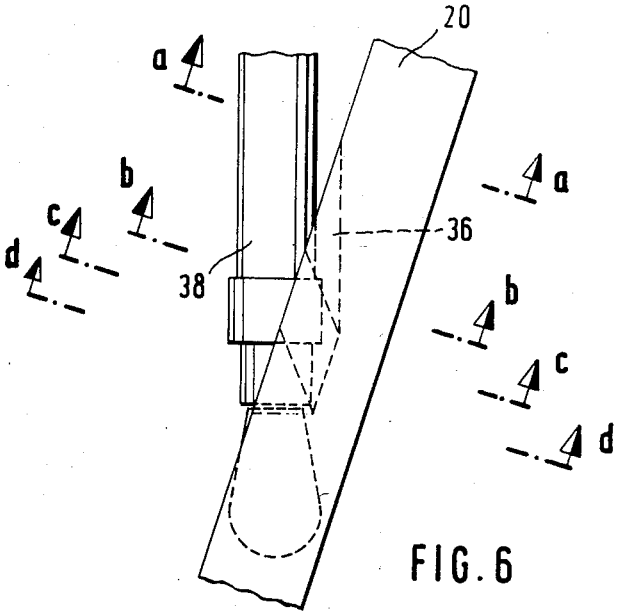
FIG. 6 is an enlarged elevation view showing a groove in the support arm of the apparatus of FIG. 1.

Referring now to FIGS. 3 through 5, rod 38 of hydraulic jack 26 acts on the lower portion of the support arm 20 via auxiliary pivoting joint 34. In accordance with another important feature of the present invention, support arm 20 is provided with groove or recess 36 which permits rod 38 to move towards pivot 34. Groove 36 has a shape selected to match the shape of that portion of jack 26 which will contact support 20 when gun 14 is in an operative or retracted position. This selected shape of recess 36 is best shown in FIG. 6 and the corresponding cross sectional diagrams in FIGS. 6A through 6D. It will be understood that the selected shape of groove 36 results from a trade off between providing a large enough passage for rod 36 and the necessity of avoiding an excessively deep recess in the support arm which would be liable to reduce its overall mechanical strength.

Groove or recess 36 provides an advantage of the present invention over known devices in that the overall space taken up by the apparatus is substantially reduced. Thus, because rod 38 of jack 26 acts on the lower portion of support arm 20, in conjunction with groove 36, jack 26 and rod 38 are always as close as possible to support 20 throughout the entire clay gun 14 pivoting phase.

A guard plate (not shown) can be mounted around support arm 20 and rod 38 of jack 26 if necessary. The plate will preferrably be detachably fixed to support arm 20.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A tadpole plugging apparatus comprising:

fixed support frame means, said frame means including a main pivoting joint;

a rotary support arm having upper and lower portions, a first end of said support arm being pivoting mounted on said main pivoting joint;

a clay gun, said clay gun being pivoting attached to a second end of said support arm, said second end being located at a lower portion of said support arm;

hydraulic jack means, said jack means having a piston rod and a cylinder, said cylinder of said jack means mounted on journals in said frame means, said journals being juxtaposed to said main pivoting joint, said piston rod of said jack means pivoting connected to said lower portion of said support arm wherein said piston rod alternately actuates said support arm and wherein said support arm alternatively urges said clay gun to pivot between retracted and operative positions; and said support arm including a bend portion, said bend portion being fixed in a plane which is substantially parallel to said fixed support frame means, and wherein said bend portion is disposed about said journals when said clay gun is in a retracted position.

2. The plugging apparatus claim 1 wherein:

said support arm includes a recess selectively dimensioned to accept a preselected portion of said jack means therein.

3. The plugging apparatus of claim 1 wherein:

said hydraulic jack means is caused to remain approximately parallel to said support arm when said support arm pivots.

4. The plugging apparatus of claim 1 wherein:

said clay gun is pivoted through an angle of about 120° between the operative position and the retracted position.

5. The plugging apparatus of claim 1 including:

a guide bar, said guide bar pivotably connected between said jack means and said clay gun.

* * * * *